US006371096B1

(12) United States Patent
Ohsaki et al.

(10) Patent No.: US 6,371,096 B1
(45) Date of Patent: Apr. 16, 2002

(54) DIAGNOSIS SYSTEM FOR WIDE-RANGE AIR-FUEL RATIO SENSOR

(75) Inventors: Masanobu Ohsaki; Seiichi Ohtani; Katsuyoshi Shiobara, all of Gunma (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/251,941

(22) Filed: Feb. 18, 1999

(30) Foreign Application Priority Data

Mar. 19, 1998 (JP) ..... 10-069699

(51) Int. Cl.[7] ..... F02D 41/00
(52) U.S. Cl. ..... 123/688; 123/696
(58) Field of Search ..... 123/688, 696; 73/23.32, 118.1; 701/109; 204/401

(56) References Cited

U.S. PATENT DOCUMENTS 5,212,947 A * 5/1993 Fujimoto et al. ..... 60/276
5,235,957 A * 8/1993 Furuya ..... 123/688
5,614,666 A * 3/1997 Hara et al. ..... 73/118.1
5,758,632 A * 6/1998 Yamashita et al. ..... 123/688
5,970,967 A * 10/1999 Uchikawa ..... 123/688

FOREIGN PATENT DOCUMENTS

JP 10-169493 6/1998

* cited by examiner

*Primary Examiner*—Willis R. Wolfe
*Assistant Examiner*—Mahmoud Gimie
(74) *Attorney, Agent, or Firm*—Foley & Lardner

(57) ABSTRACT

A diagnosis system for a wide-range A/F sensor receives an air-fuel ratio (A/F) of air-fuel mixture supplied to an engine for the A/F sensor. An control unit of the diagnosis system corrects an A/F controlled object of a feedback control on the basis of a detection result of the A/F sensor to adjust the A/F at a target A/F. The control unit diagnoses an abnormality of the A/F sensor from variation of the detection value of the A/F sensor during a time period from the start of the switching of the target A/F. The control unit sets a control gain of an A/F feedback control at a value greater than a normal control gain during the diagnosis.

7 Claims, 8 Drawing Sheets

SENSOR OUTPUT $$IP = Do2 \frac{P \cdot S}{T \cdot 1} \ln\left(\frac{1}{1 - Po2/P}\right)$$

Do2 : OXYGEN DIFFUSION COEFFICIENT AT POROUS LAYER
S : AREA OF CATHOD
1 : THICKNESS OF POROUS LAYER
P : TOTAL PRESSURE
Po2 : PARTIAL PRESSURE OF OXYGEN

DIAGNOSIS SYSTEM FOR WIDE-RANGE AIR-FUEL RATIO SENSOR

BACKGROUND OF THE INVENTION

The present invention relates to an abnormality diagnosing system of a wide-range A/F (air-fuel ratio) sensor.

A Japanese Patent Provisional Publication No. 10-169493 discloses a conventional abnormality diagnosing system of a wide-range A/F sensor. This abnormality diagnosing system is arranged to diagnose the degradation of the wide-range A/F sensor by monitoring the change of the output of the wide-range A/F sensor.

SUMMARY OF THE INVENTION

However, the conventional abnormality diagnosing system has been arranged to employ an air-fuel ratio control constant used in a normal air-fuel ratio (A/F) control even when the diagnosis of the wide-range A/F sensor is executed. The A/F control constant includes a proportional term (P-term), an integration term (I-term) and a derivative term (D-term). Therefore, the dispersion of the products of the wide-range A/F sensor and the dispersion of the air-fuel ratio at a start of the diagnosis cause a fluctuation of the time period until the output of the wide-range A/F sensor reaches a target air-fuel ratio. This fluctuation of the time period to the target value may cause a misdiagnosis as shown in FIGS. 7A and 7B and degrade the accuracy of the diagnosis. The conventional system has been arranged such that the air-fuel ratio control constant under a normal air-fuel ratio control range is set on the basis of an amplitude and a convergence of the air-fuel ratio control so as to satisfy the desired characteristics required in the normal control range as shown in FIG. 8.

It is therefore an object of the present invention to provide an improved diagnosis system for a wide-range air-fuel ratio sensor. The improved diagnosis system further accurately diagnoses whether a wide-range air-fuel ratio sensor operates correctly or not without complicating its construction.

A diagnosis system according to the present invention comprises a wide-range air-fuel ratio sensor, an air-fuel ratio feedback control section, a target air-fuel ratio switching section, a detection value variation detecting section, an abnormality diagnosing section and a diagnosis control gain setting section which are arranged as shown in FIG. 6. The wide-range air-fuel ratio sensor detects an air-fuel ratio of air-fuel mixture supplied to an engine. The air-fuel ratio feedback control section corrects an air-fuel ratio controlled object on the basis of a detection result of the wide-range air-fuel ratio sensor so as to adjust the air-fuel ratio to the engine at a target air-fuel ratio. The target air-fuel ratio switching section switches the target air-fuel ratio. The detection value variation detecting section detects variation of the detection value of the wide-range air-fuel ratio sensor. The abnormality diagnosing section diagnoses the wide-range air-fuel ratio sensor on the basis of a detection result of the detection value variation detecting section during a time period from the start of the switching of the target air-fuel ratio by the target air-fuel ratio switching section. The diagnosis control gain setting section sets a control gain of the air-fuel ratio feedback control section at a value greater than a normal control gain when the diagnosis of the wide-range air-fuel ratio sensor is executed.

BRIEF DESCRIPTION OF THE DRAWINGS

In the drawings, like reference numerals designate like parts and element throughout all figures, in which.

DETAILED DESCRIPTION OF THE INVENTION

Referring to FIGS. 1 to 6, there is shown an embodiment of a diagnosis system for a wide-range A/F (air-fuel ratio) sensor 18 in accordance with the present invention. The diagnosis system for the wide-range A/F sensor 18 is employed in an exhaust gas air-fuel ratio detecting system of an internal combustion engine 11.

Figure 1:
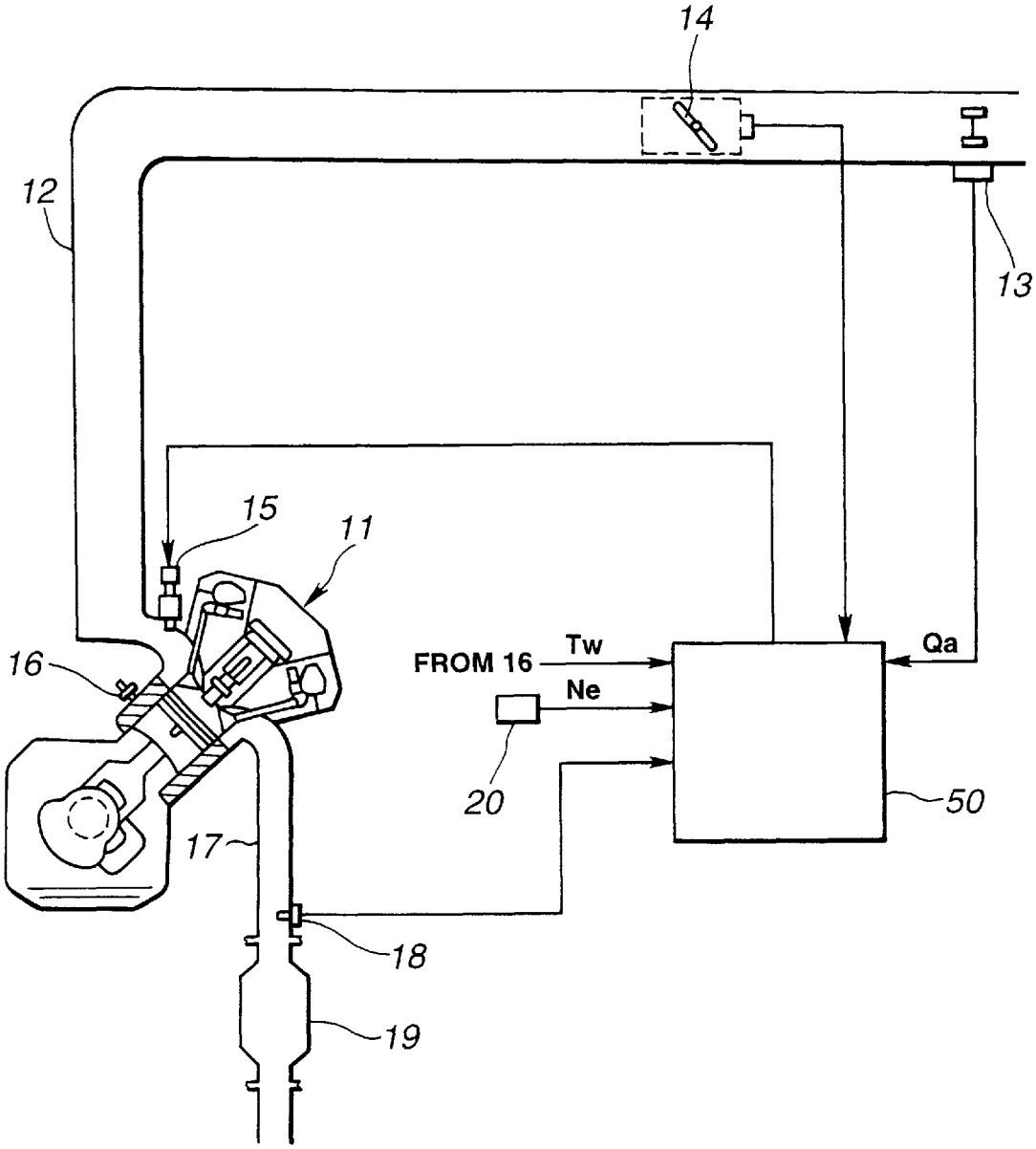
FIG. 1 is a schematic view showing an embodiment of an abnormality diagnosis system of a wide-range A/F sensor in accordance with the present invention.

As shown in FIG. 1, an air flow meter 13 and a throttle valve 14 are installed in an intake passage 12 of the engine 11. The air flow meter 13 detects an intake air quantity Qa supplied to the engine 11, and the throttle valve 14 varies the intake air quantity Qa according to an operation of an acceleration pedal (not shown). A fuel injection valve 15 of an electromagnetic type is installed in an intake manifold for each cylinder of the engine 11. The intake manifold of the engine 11 is connected to a downstream end of the intake passage 12. The fuel injection valve 15 is opened according to a drive pulse signal outputted from a control unit 50. The fuel injection valve 15 receives fuel pressurized at a predetermined pressure by means of a fuel pump (not shown) and a pressure regulator (not shown). Therefore, when the fuel injection valve 15 receives the drive pulse signal from the control unit 50, the fuel injection valve 15 injects the fuel corresponding to the drive pulse signal into the intake manifold for each cylinder of the engine 11.

Installed to the engine 11 is a water temperature sensor 16 for detecting a temperature of cooling water in a cooling jacket of the engine 11. The wide-range A/F sensor 18 is disposed in an exhaust gas passage 17 in the vicinity of an exhaust manifold of the engine 11. The wide-range A/F sensor 18 detects an air-fuel ratio of the mixture of intake air and injected fuel by detecting a density of a special composition such as oxygen in the exhaust gases discharged from the engine 11. A three-way catalytic converter 19 is disposed downstream of the wide-range A/F sensor 18 in the exhaust passage 17. The three-way catalytic converter 19 functions to preferably purify the exhaust gases by executing the oxidation of CO and HC and the deoxidization of NOx when the air-fuel ratio is generally stoichiometric air-fuel ratio (A/F=(air weight/fuel weight)≈14.7, excess air ratio λ=1). The catalyst employed in this three-way catalytic converter 19 may be a lean NOx catalyst which deoxidizes NOx in the lean range (lean A/F) or a common oxidizing catalyst.

Figure 4:
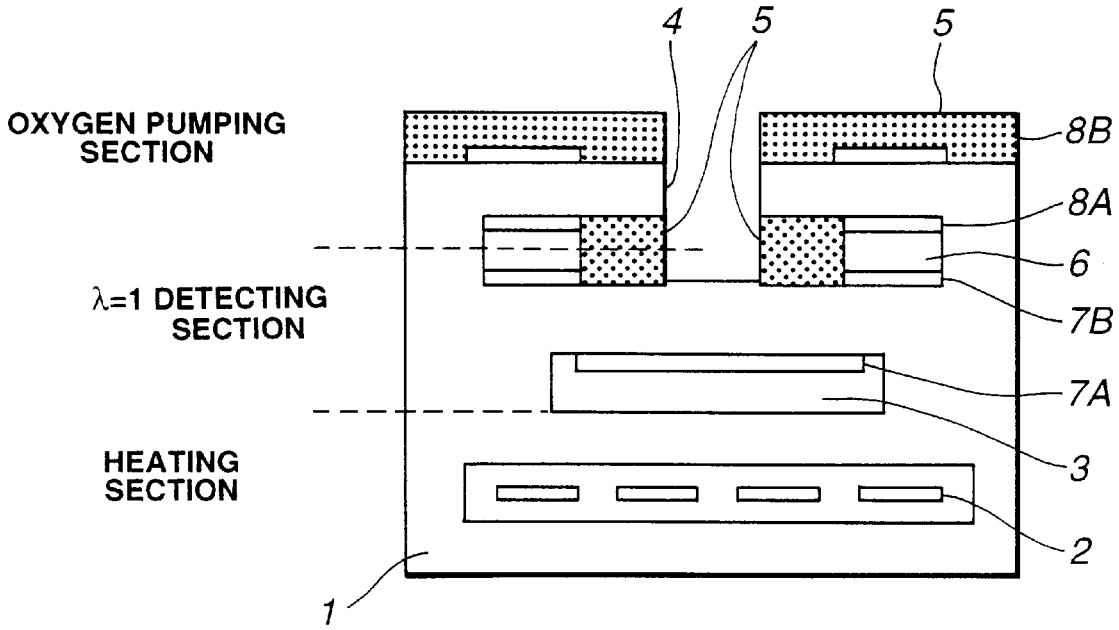
FIG. 4 is a cross section view showing a structure of the wide-range A/F sensor.

The structure and the principle of the air-fuel ratio detection by the wide-range A/F sensor 18 will be discussed hereinafter. A main body 1 of the A/F sensor 18 is made of heat-resistant porous material such as zirconia $Zr_2O_3$ having an oxygen ion transporting property. As shown in FIG. 4, the main body 1 comprises a heater section 2 and an atmospheric air inlet hole 3 communicated with atmospheric air (reference gas) and a gas diffusion layer 6 communicated with objective gas such as exhaust gases exhausted from the engine 11 through an objective gas inlet hole 4 and a protecting layer 5. The sensing electrodes 7A and 7B are disposed in the atmospheric air inlet hole 3 and the gas diffusion layer 6, respectively. Oxygen pumping electrodes 8A and 8B are disposed at the gas layer 6 and a peripheral portion of the main body 1 corresponding to that of the gas layer 6, respectively.

The sensing electrodes (sensing section) 7A and 7B are arranged to detect the voltage generated between the sensing electrodes 7A and 7B according to the oxygen partial pressure which is affected by the oxygen ion density (oxygen partial pressure) in the gas diffusion layer 6. On the other hand, a predetermined voltage is applied between the oxygen pumping electrodes 8A and 8B (special component pumping section). That is, the sensing electrodes 7A and 7B are arranged to detect whether the air-fuel ratio is rich or lean with respect to the stoichiometric air-fuel ratio (air excess ratio λ=1) by detecting the voltage generated between the electrodes 7A and 7B according to the oxygen partial pressure.

Figure 5A:
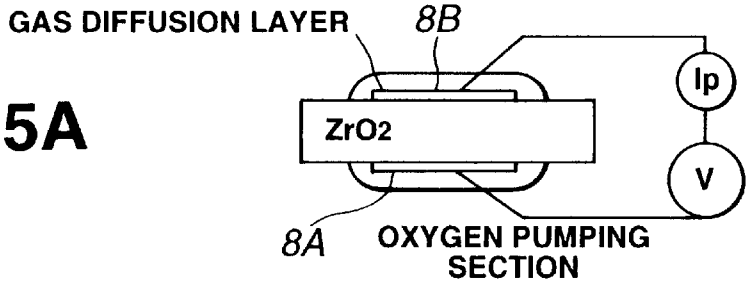
FIG. 5A is a schematic view for explaining a function of the wide-range A/F sensor.

On the other hand, the oxygen pumping electrodes 8A and 8B, which can be represented by a model view of FIG. 5A, transport the oxygen ion in the gas diffusion layer 6 according to a predetermined voltage applied to the oxygen pumping electrodes 8A and 8B so that an electric current flows between the oxygen pumping electrodes 8A and 8B. The value (limit current) Ip of the electric current flowing between the oxygen pumping electrodes 8A and 8B according to the predetermined voltage is influenced by the density of the oxygen ion in the gas diffusion layer 6. Therefore, by detecting the limit current Ip, the air-fuel ratio (excess air ratio λ) of the objective gas can be detected. For example, a relationship among the electric current and the voltage between the oxygen pumping electrodes 8A and 8B and the excess air ratio λ is obtained as shown by Table A of FIG. 5B. By switching the applied voltage direction to the oxygen pumping electrodes 8A and 8*b* on the basis of the rich or lead output of the sensing electrodes 7A and 7B, the air-fuel ratio in both of the rich range and the lean range is detected on the basis of the current value Ip between the oxygen pumping electrodes 8A and 8B.

Figure 5B:
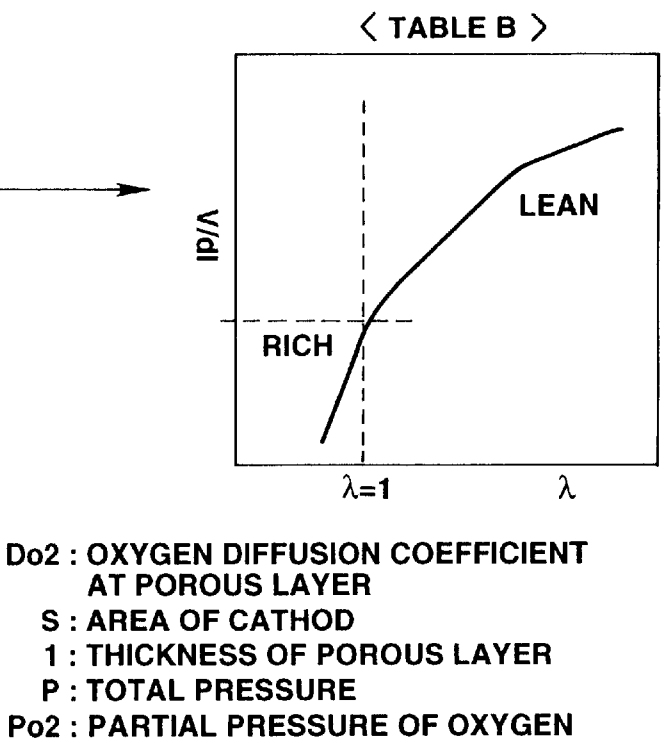
FIG. 5B is tables and an equation for explaining the detection algorithm of the system.
Figure 6:
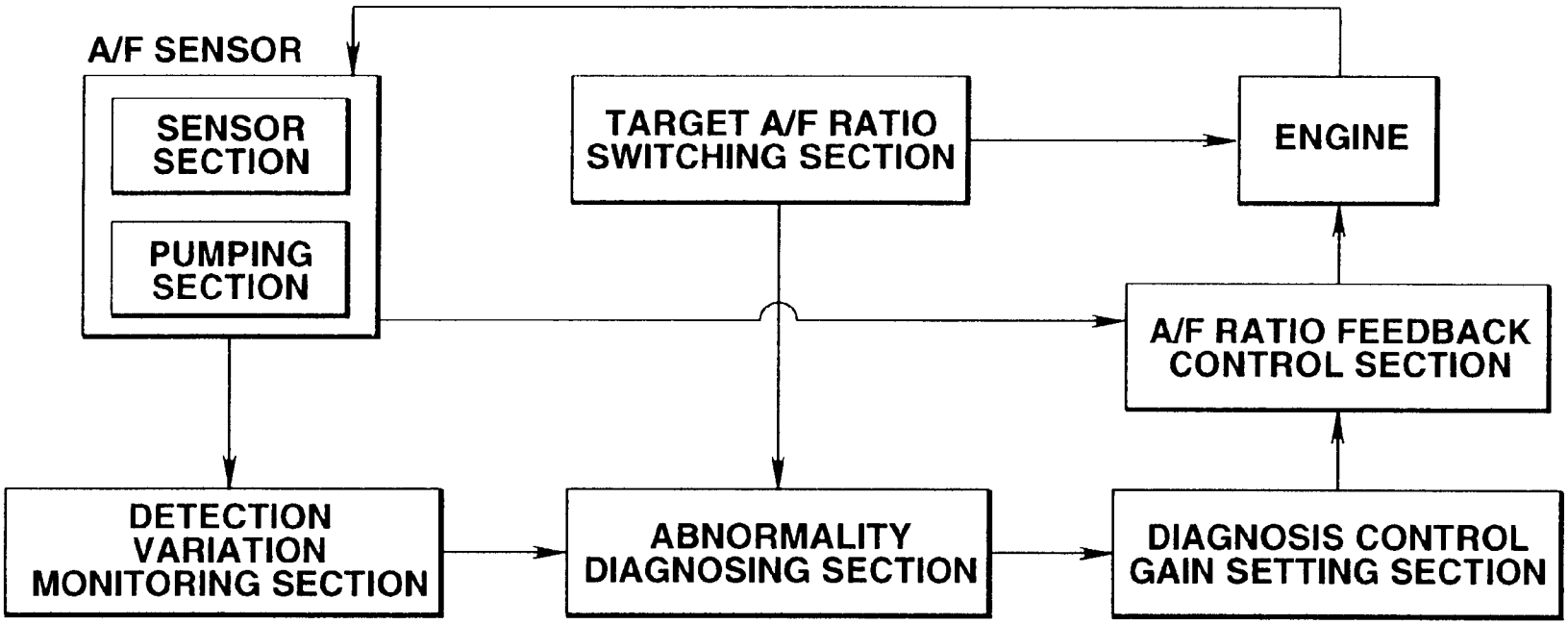
FIG. 6 is a block diagram for explaining a typical structure of the diagnosing system according to the present invention.
Figure 7A:
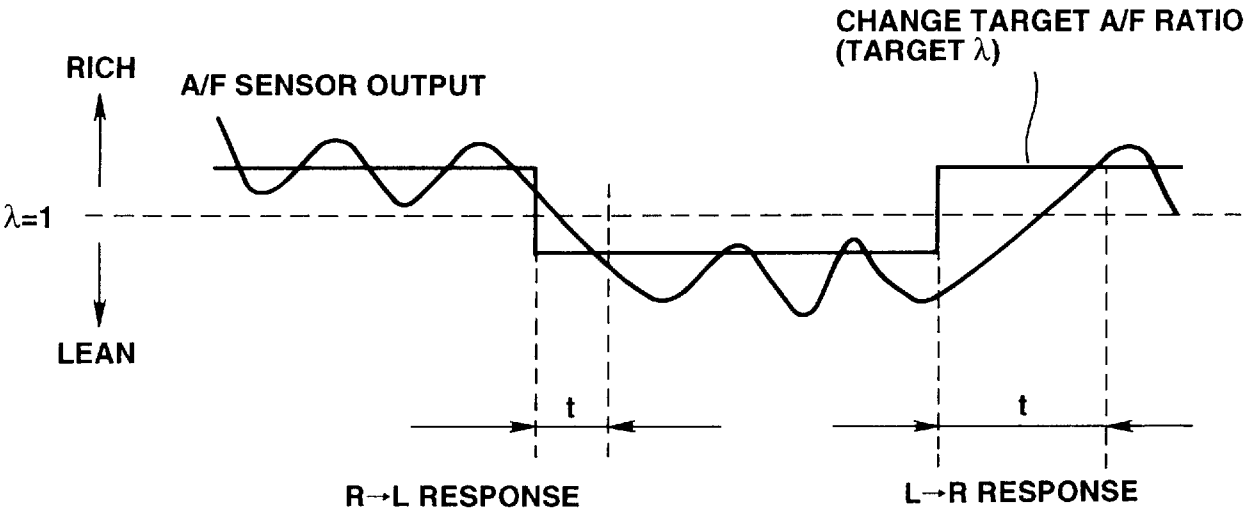
FIG.7A (PRIOR ART)
FIGS. 7A and 7B are graphs for explaining a problem of a conventional diagnosis system.
Figure 7B:
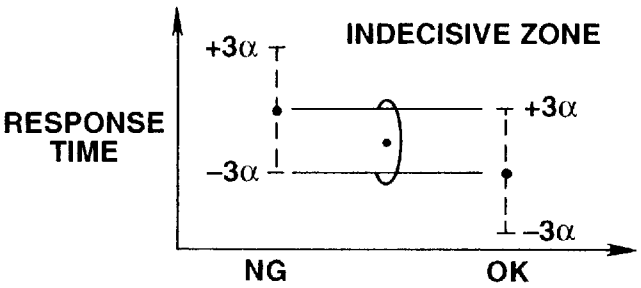
FIG.7B (PRIOR ART)
Figure 8:
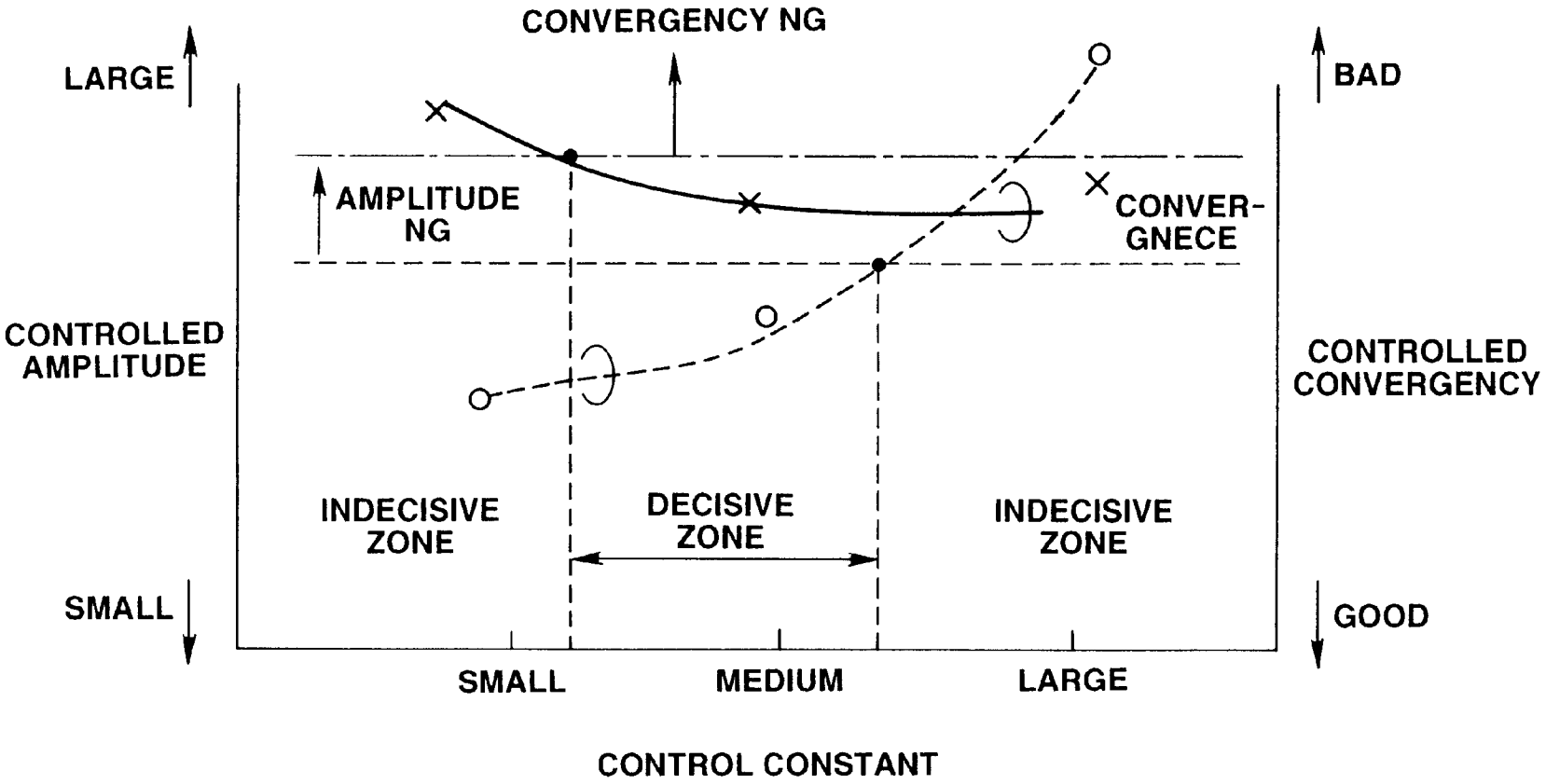
FIG.8 (PRIOR ART)
FIG. 8 is a graph for explaining a conventional method of setting control constants in a normal air-fuel ratio feedback control.

By detecting the current value Ip between the oxygen pumping electrodes 8A and 8B on the basis of the above-mentioned air-fuel ratio detection principle and by referring to Table B of FIG. 5B, the actual air-fuel ratio of the objective gas is detected in the wide-range.

The sensor detection value Ip is obtained by the following equation (1).

$$Ip=\mathrm{Do}2\cdot P\cdot S/(T\cdot L)\cdot \ln\{1/(1-\mathrm{Po}2/P)\} \quad (1)$$

wherein Do2 is an oxygen gas diffusion coefficient of the porous layer, S is an electrode area of the cathode, L is a thickness of the porous layer, P is a total pressure, Po2 is a partial pressure of oxygen, and T is temperature.

A crank angle sensor 20 installed in a distributor (not shown) outputs a unit angle signal of a crankshaft to the control unit 50. The control unit 50 counts the number of the unit angle signal for a predetermined time or measures the cycle of the crank reference angle signal to detect the engine rotation speed Ne.

The control unit 50 is constituted by a microcomputer which comprises CPU, ROM, RAM, A/D converter and I/O interface. The control unit 50 receives various input signals from various sensors and controls the fuel injection quantity (A/F controlled quantity) of the fuel injection valve 15 according to the input signals. The various sensors connected to the control unit 50 include the wide-range A/F sensor 18, the air flow meter 13, the water temperature sensor 16 and the crank angle sensor 20.

The control unit 50 calculates the intake air flow rate Qa on the basis of a voltage signal outputted from the air flow meter 13 and calculates an engine rotation speed Ne on the basis of the signal outputted from the crank angle sensor 20. The control unit calculates a basic fuel injection pulse width Tp corresponding to the fuel injection quantity on the basis of the intake air flow rate Qa, the engine rotation speed Ne and the following equation (2).

$$Tp=c\times Qa/Ne \quad (2)$$

wherein c is a constant.

Further, the control unit 50 calculates a final effective fuel injection pulse width Te on the basis of a water temperature correction coefficient Kw for forcibly correcting the air-fuel ratio to the rich side when the water temperature is low, a start increment correction coefficient Kas, an air-fuel ratio feedback correction coefficient (air-fuel ratio feedback correction value) α and the following equation (3).

$$Te=Tp\times(1+Kw+Kas+\ldots)\times LAMBDA\times Z+Ts \quad (3)$$

wherein Z is a target air-fuel ratio, and Ts is a voltage correction quantity. The air-fuel ratio feedback correction coefficient LAMBDA is set as follows.

$$LAMBDA=P+I+D-2.0 \quad (4)$$

$$P=KP\times DILMD \quad (5)$$

wherein KP is a value (z-axis value) obtained from a three-dimensional map on the basis of the engine rotation speed Ne (x-axis value) and the load Tp (y-axis value).

$$I=KI\times DILMD \quad (6)$$

wherein KI is a value (z-axis value) obtained from a three-dimensional map on the basis of the engine rotation speed Ne (x-axis value) and the load Tp (y-axis value).

$$D=KD\times DDILMD \quad (7)$$

wherein KD is a value (z-axis value) obtained from a three-dimensional map on the basis of the engine rotation speed Ne (x-axis value) and the load Tp (y-axis value).

$$DILMD=AAFLMD-TGLMD \quad (8)$$

wherein AFLMD is the output of the wide-range A/F sensor 18, and TGLMD is a target air-fuel ratio.

$$DDILMD=DILMD-DILMD_{OLD} \quad (9)$$

wherein $DILMD_{OLD}$ is a previous DILMD 10 msec prior to the present DILMD.

Although the present embodiment has been shown and described so as to calculate LAMGDA on the basis of the P-term, the I-term and the D-term, it will be understood that the LAMBDA may be calculated on the basis of one of the P-term, the I-term and the D-term, such as PI control or PD control.

Hereinafter, the basic method as to the abnormality diagnosis control of the wide-range A/F sensor 18 executed by the control unit 50 according to the present invention will be discussed.

The abnormality diagnosis of the wide-range A/F sensor 18 is executed such that the target air-fuel ratio is changed when the actual air-fuel ratio (detection value) detected by the wide-range A/F sensor 18 is controlled to the target air-fuel ratio by executing feedback control of the A/F controlled object (fuel injection quantity or intake air flow rate). During this time, since the A/F controlled object such as the fuel injection quantity or intake air flow rate is varied according to the change of the target air-fuel ratio. Therefore, when the wide-range A/F sensor 18 is put in a normal condition, the detection value of the wide-range A/F sensor 18 should be varied according to the change of the target air-fuel ratio. Accordingly, by monitoring the detection value of the wide-range A/F sensor 18 according to the change of the target air-fuel ratio, it is possible to diagnose whether the wide-range A/F sensor 18 is normal or abnormal.

More particularly, the abnormality of the wide-range A/F sensor 18 such as the degradation of the responsibility of the wide-range A/F sensor 18 can be finely diagnosed by detecting a time consumed for converging the detection value of the wide-range A/F sensor 18 from the change of the target air-fuel ratio or time from the change of the target air-fuel ratio to a moment that the detection value of the wide-range A/F sensor 18 crosses with the target air-fuel ratio or a preset value to the target air-fuel ratio. The degradation of the responsibility of the wide-range A/F sensor 18 is caused by the blinding of the gas diffusion layer 6, the degradation of each electrode and the trouble of a control circuit for the heater cell 2.

Further, it will be understood that the diagnosis of the abnormality of the wide-range A/F sensor 18 may be executed by detecting the gradient of the change of the detection value of the wide-range A/F sensor 18 after the change of the target air-fuel ratio.

Since frequent changes of the target air-fuel ratio for the abnormality diagnosis of the wide-range A/F sensor 18 may degrade the exhaust gas purifying performance of the three-way catalyst 19 (or lean NOx catalyst or oxidation catalyst), it is preferable to restrict the frequency of the changes of the target air-fuel ratio within an allowable range with respect to the exhaust gas purifying performance of the three-way catalyst 19.

Hereinafter, the catalyst perturbation control proposed by the inventor of the present invention will be discussed.

In the air-fuel ratio feedback control employing a wide-range A/F sensor 18 which can detect the air-fuel ratio within a wide-range, the frequency of the changes between the rich and lean conditions is small as compared with the case of the air-fuel ratio feedback control employing the oxygen sensor which detects whether the air-fuel ratio is a rich state or lean state with respect to the stoichiometric air-fuel ratio. Therefore, the adsorption and desorption of the oxygen at the surface of the catalyst is not effective. This may degrade the efficiency for simultaneously purifying NOx, CO and HC which are so-called three terms. In order to suppress this degradation, the air-fuel ratio feedback control employing the wide-range A/F sensor 18 is arranged, as shown in FIG. 4, to forcibly fluctuate the air-fuel ratio (target A/P) so as to improve the exhaust gas purifying performance of the three terms as possible. This control is the catalyst perturbation control proposed by the inventor of the present invention.

By monitoring the change of the detection value of the wide-range A/F sensor 18 according to the forcible changes of the target air-fuel ratio for improving the exhaust gas purifying performance during this catalyst perturbation control, the abnormality of the wide-range A/F sensor 18 is diagnosed. That is, it is possible to finely diagnose the abnormality of the wide-range A/F sensor 18 while improving the exhaust gas purifying performance of the catalyst by means of the catalyst perturbation control.

Furthermore, the abnormality diagnosis system of the wide-range A/F sensor 18 in accordance with the present invention is arranged to set the air-fuel ratio control constant (P, I, D and therefore LAMBDA, in other word, a control gain) at a value different from that in the normal air-fuel ratio control during the abnormality diagnosing process, so as to improve the accuracy of the diagnosis by possibly suppressing the time for the convergence of the output of the A/F sensor 18 to the air-fuel ratio switched for the diagnosis.

That is, the abnormality diagnosis system of the embodiment according to the present invention is arranged to execute the abnormality diagnosis control of the wide-range A/F sensor 18 as explained hereinafter.

Figure 2:
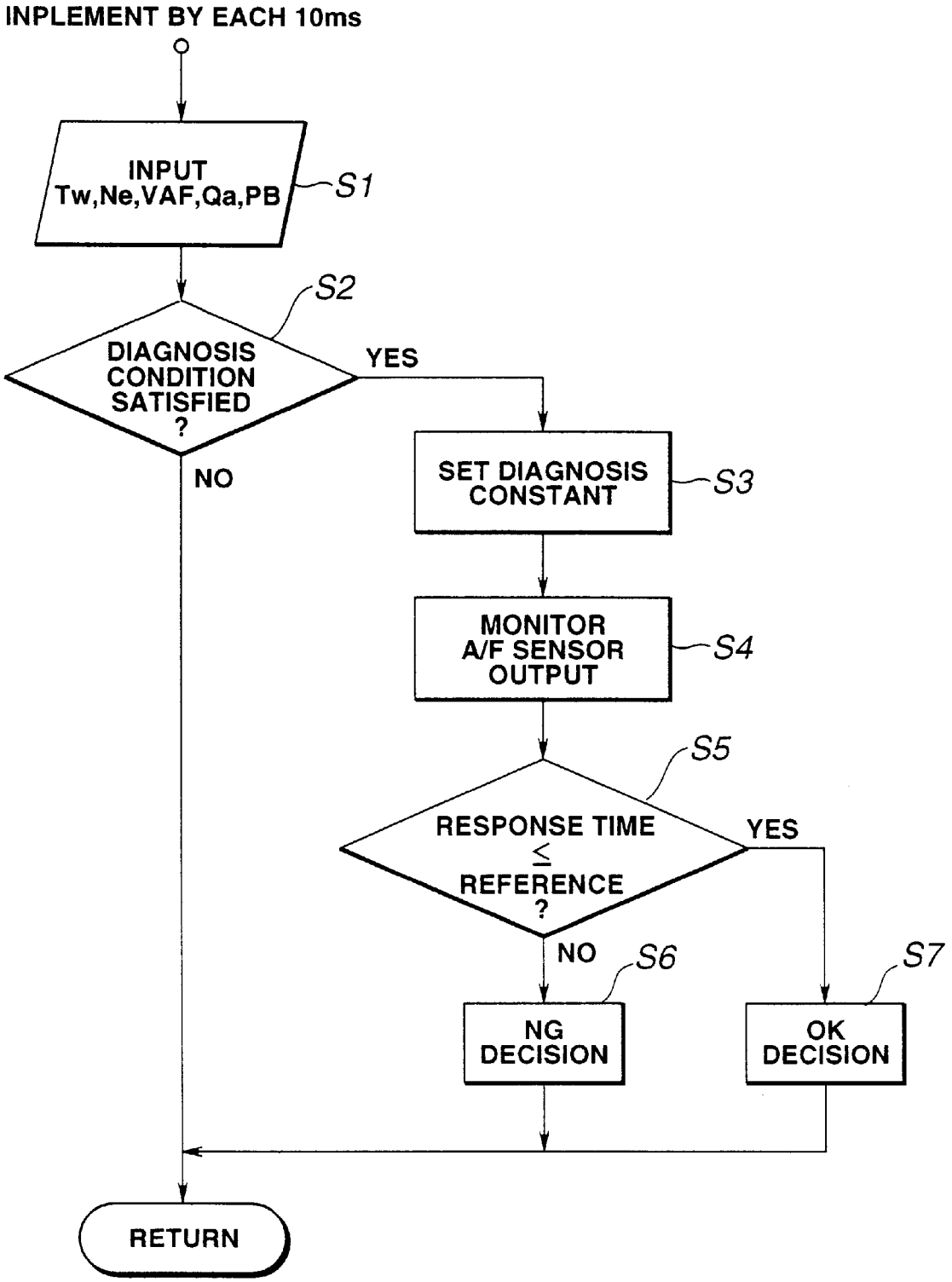
FIG. 2 is a flowchart showing an abnormality diagnosis control executed by the abnormality diagnosis system of FIG. 1.

With reference to a flowchart of FIG. 2, the abnormality diagnosis control executed by the control unit 50 will be discussed. An air-fuel ratio feedback control section, a target air-fuel ratio switching section, a detection value change detecting section, an abnormality diagnosing section and a diagnosis control gain setting section of FIG. 6 correspond to the process executed by the control unit 50 as shown in the flowchart of FIG. 2.

At a step S1, the control unit 50 reads the outputs of the sensors 13, 14, 16, 18 and 20. That is, the control unit 50 reads the signal indicative of the cooling water temperature Tw of the engine, the signal indicative of the engine rotation speed Ne, the signal VAF outputted from the wide-range A/F sensor 18, the signal indicative of the intake air flow rate Qa, and the signal indicative of the intake air pressure PB.

At a step S2, the control unit 50 decides whether the abnormality diagnosis starting condition is satisfied or not. That is, the control unit 50 checks whether all of the following four conditions are satisfied or not.

Firstly, the control unit 50 decides whether a predetermined time period has elapsed from the start of the engine 11 that the ignition switch was turn on and then turn off. This first check is executed to prevent misdiagnosis such as a misdiagnosis due to the fuel increment during starting period and the influence of a fuel flow on a wall of the intake passage, and a misdiagnosis executed under a condition that the wide-range A/F sensor 18 is yet inactive.

Secondly, the control unit 50 decides whether the sensor activity checking process of the wide-range A/F sensor 18 has been already finished or not. The decision is executed in order to prevent the misdiagnosis caused by the execution of the abnormality diagnosis process under the sensor inactive condition. More particularly, this sensor activity check is executed by checking the cooling water temperature Tw and the output VAF of the wide-range A/F sensor 18.

Thirdly, the control unit 50 decides-whether the air-fuel ratio feedback control condition is satisfied and the catalyst perturbation control is executed. When the catalyst perturbation control is not being executed, the control unit 50 decides that the third condition is not satisfied. During the catalyst perturbation control, the purifying efficiency of the three terms (NOx, CO, HC) is improved by fluctuating the air-fuel ratio at the inlet of the catalyst 19 by a predetermined quantity at predetermined cycle intervals. Therefore, the diagnosis accuracy of the abnormality diagnosis of the wide-range A/F sensor 18 is improved. This enables the abnormality diagnosis to be accurately executed while maintaining the exhaust gas characteristic at a preferable state. This third diagnosis is executed by deciding whether the engine rotation speed Ne, the intake air flow rate Qa, the intake air pressure PB and the vehicle speed VSP are in preset ranges, respectively.

Fourthly, the control unit 50 decides whether the catalyst 19 is activated or not. When the control unit 50 decides that the catalyst 19 is not activated, the abnormality diagnosis process is not executed. That is, when the catalyst 19 is not activated, the air-fuel ratio is generally kept at the lean side so as to reduce the exhaust quantity of HC and to promote the activation of the catalyst 19. Therefore, if the air-fuel ratio is fluctuated under such condition, the exhaust gas property may be degraded. The fourth decision is executed on the basis of the cooling water temperature Tw of the engine 11 and the output VAF of the A/F sensor 18.

Only when all of the first to fourth conditions are satisfied, the routine proceeds from the step S2 to a step S3. When at least one of the first to fourth conditions is not satisfied, the routine returns to a start sped and awaits the next processing implemented by each 10 ms.

At the step S3, the control unit 50 decides the diagnosis control constant (diagnosis control gain) and executes the air-fuel ratio feedback control on the basis of the diagnosis control constant. More particularly, as to the P-term, the corrected P-term is obtained by multiplying the diagnosis correction coefficient with the base P-term calculated by the equation (5) such that P←P×(diagnosis correction coefficient). As to the I-term, the corrected I-term is obtained by multiplying the diagnosis correction coefficient with the base I-term calculated by the equation (6) such that I←I×(diagnosis correction coefficient). As to the D-term, the corrected D-term is obtained by multiplying the diagnosis correction coefficient with the base D-term calculated by the equation (7) such that D←D×(diagnosis correction coefficient). The diagnosis air-fuel ratio feedback control correction coefficient LAMBDA is calculated on the basis of the corrected P, I and D terms and the following equation (4).

$$LAMBDA=P+I+D-2.0$$

It was resulted from the experiments that it was preferable in view of the diagnosis accuracy and the control characteristics that the diagnosis air-fuel ratio feedback control correction coefficient LAMBDA is set at about one and half times the normal air-fuel ratio feedback correction coefficient LAMBDA. For example, it is preferable that P←P×1.0, I←I×1.5 and D←D×1.0.

By using the corrected LAMBDA set at high response characteristic, the high response feedback control is executed during the diagnosis process.

At a step S4, the control unit 50 monitors the output value of the wide-range A/F sensor 18. More particularly, the control unit 50 monitors the response of the output value of the wide-range A/F sensor 18 during the air-fuel ratio switching period for switching from the rich range to the lean range or from the lean range to the rich range.

Figure 3:
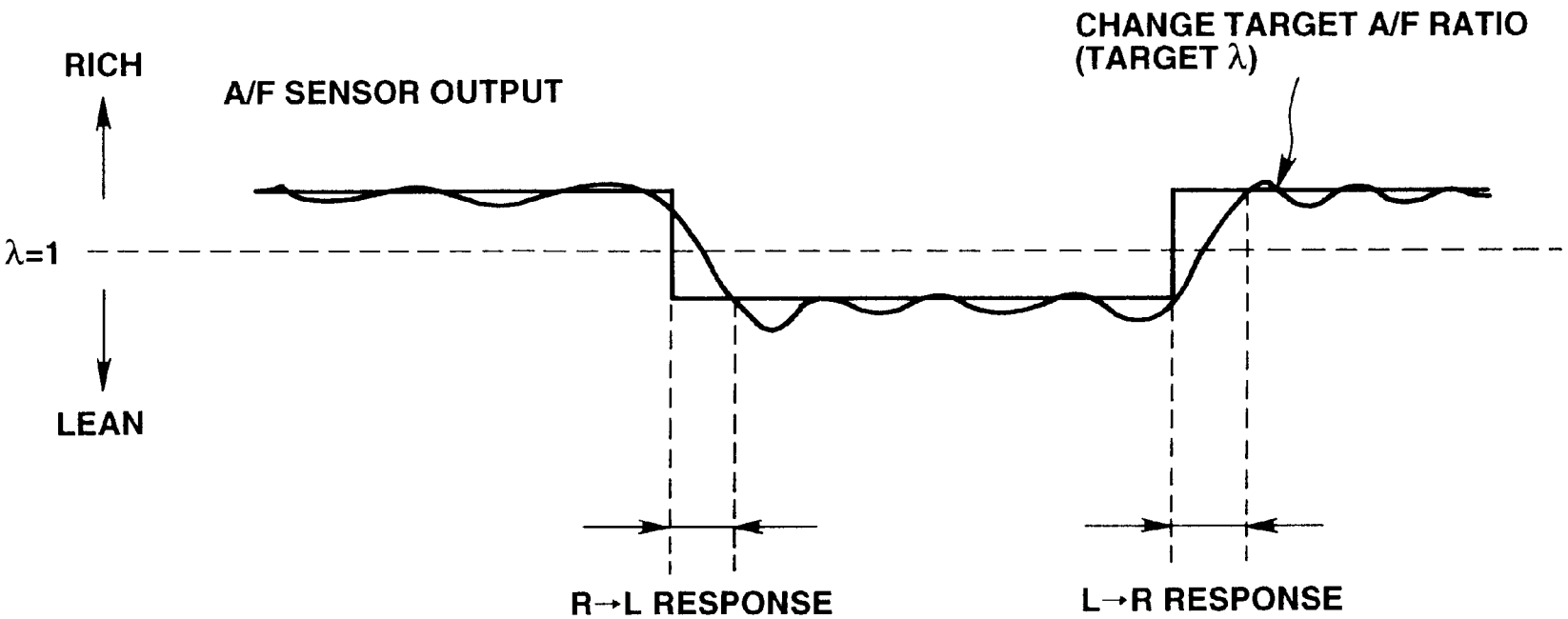
FIG. 3 is a time chart which shows a response of the wide-range A/F sensor according to the switching of the target air-fuel ratio.

At a step S5, the control unit 50 decides as to the responsibility of the wide-range A/F sensor 18. More particularly, the control unit 50 decides whether the time period from the target air-fuel ratio switching point (lean to rich or rich to lean) to the moment that the detection value of the wide-range A/F sensor 18 crosses with the target air-fuel ratio (rich range target value or lean range target value) is smaller than the diagnosis reference time, as shown in FIG. 3. When the response time is greater than the diagnosis reference time, the routine proceeds to a step S6. When the response time is smaller or equal to the reference time, the routine proceeds to a step S7.

At the step S6, the control unit 50 makes a NG decision that the responsibility of the wide-range A/F sensor 18 is abnormal. That is, the control unit 50 diagnoses that the wide-range A/F sensor 18 makes troubles such as the blinding of the gas diffusion layer 6, the degradation of each electrode, or trouble of the control circuit of the heater cell 2. Then, this present routine terminated. When the control unit 50 made the NG decision twice continuously, the control unit 50 turns on an alarm lamp (MIL) to inform the abnormality of the wide-range A/F sensor 18 to a vehicle occupant. Further, in order to avoid the degradation of the drivability and the exhaust performance, the air-fuel ratio feedback control based on the detection value of the wide-range A/F sensor 18 is forbidden. Furthermore, it will be understood that the lean burn control may be forcibly forbidden.

At thee step S7, the control unit 50 makes OK decision that the wide-range A/F sensor 18 is normal. Then, the present routine is terminated.

In case that the first diagnosis was the NG decision and the next diagnosis was the OK decision, the first diagnosis might be misdiagnosis. Therefore, when both of the continuous twice diagnosis were NG decision, the control unit 50 turns on the alarm lamp. Further, it will be understood that in case that the abnormality diagnoses have been executed predetermined times, when the NG decision were given at the predetermined rate, the alarm lamp may be turned ON. Furthermore, the alarm lamp may be turned ON even when the NG decision is given once.

With the thus arranged abnormality diagnosis system according to the present invention, in case that the abnormality diagnosis of the wide-range A/F sensor 18 is executed on the basis of the response time of the wide-range A/F sensor 18 according to the switching of the target air-fuel ratio during the air-fuel ratio feedback control, the air-fuel ratio control constant (LAMBDA constituted by P term, I term and D term, that is, a control gain) is set at a high-response value. Therefore, it is possible to suppress the dispersion of the response time among the A/F sensors which dispersion is generated by the dispersion of the products of the A/F sensors or the dispersion of the air-fuel ratio at the start of the abnormality diagnosis. This simplifies the setting of the reference value and suppresses the misdiagnosis and improves the accuracy of the diagnosis.

Further, since the abnormality diagnosis system according to the present invention is arranged to the diagnosis air-fuel ratio control constant only during the diagnosis process, the air-fuel ratio feedback control is normally executed within the normal air-fuel ratio control range. Therefore, the fluctuation of the air-fuel ratio and the stability of the control are not disturbed thereby. Furthermore, the degradation of the drivability and the exhaust gas performance due to the abnormality diagnosis process is suppressed minimum.

Since the embodiment of the present invention is arranged to set the diagnosis air-fuel ratio control constant (control gain) by changing the setting of the P-term, the I-term and the D-term, the degree of freedom of the responsibility and the convergent property of the air-fuel ratio feedback control is expanded. This preferably functions to properly satisfy the diagnosis accuracy and the various performance such as the drivability and the exhaust gas performance.

With the thus arrange diagnosing system according to the present invention, when the diagnosis of the wide-range A/F sensor 18 is being executed, the control gain of the air-fuel ratio feedback control is set at the high responsibility value for the diagnosis. This suppresses the misdiagnosis due to the dispersion of the products of the wide-range A/F sensor 18 and the dispersion of the air-fuel ratio at the start of the diagnosis. Therefore, the accuracy of the diagnosis is improved. Further, since the control gains are changed only during the diagnosis process, the normal air-fuel ratio feedback control is executed under the normal air-fuel ratio control range. That is, the magnitude of the air-fuel ratio and the control convergence are kept small, and therefore the degradations of the drivability and the exhaust gas performance are kept minimal.

Further, since it is possible to change the setting of the control gain during the diagnosis by changing at least one of the P-term, the I-term and the D-term, it is possible to expand the degree of the freedom of the responsibility and the convergent characteristic of the air-fuel ratio feedback control. This expanding of the degree of the freedom is preferable to enable the improvement of the diagnosis accuracy and the required characteristics to be compatible.

Furthermore, it becomes possible to improve the purifying capacity of the catalyst by the target air-fuel ratio magnitude of the catalyst perturbation control and to execute the diagnosis of the wide-range A/F sensor 18 by utilizing the target air-fuel ratio magnitude. Accordingly, the diagnosis of the wide-range A/F sensor 18 is executed speedily and accurately, and the exhaust gas purifying performance is highly maintained.

The entire contents of Japanese Patent Application No. 10-69699 filed on Mar. 19, 1998 in Japan, are hereby incorporated by reference.

What is claimed is:

1. A diagnosis system comprising:

a wide-range air-fuel ratio sensor detecting an air-fuel ratio of air-fuel mixture supplied to an engine;

an air-fuel ratio feedback control means for correcting an air-fuel ratio controlled object on the basis of a detection result of said wide-range air-fuel ratio sensor so as to adjust the air-fuel ratio to the engine at a target air-fuel ratio;

a target air-fuel ratio switching means for switching the target air-fuel ratio;

a detection value variation detecting means for detecting variation of the detection value of said wide-range air-fuel ratio sensor;

an abnormality diagnosing means for diagnosing said wide-range air-fuel ratio sensor on the basis of a detection result of said detection value variation detecting means during a time period from the start of the switching of the target air-fuel ratio by said target air-fuel ratio switching means; and a diagnosis control gain setting means for setting a control gain of said air-fuel ratio feedback control means at a value greater than a normal control gain when the diagnosis of said air-fuel ratio sensor is executed.

2. A diagnosis system as claimed in claim 1, wherein said diagnosis control gain setting means sets the control gain during the diagnosis by changing at least one of a proportional term, an integration term and a derivative term defining the control gain.

3. A diagnosis system as claimed in claim 1, wherein said target air-fuel ratio switching means forcibly fluctuates the target air-fuel ratio.

4. A diagnosis system as claimed in claim 1, wherein said abnormality diagnosing means diagnoses the abnormality of said wide-range air-fuel ratio sensor on the basis of a time period taken to reach the detection value of said wide-range air-fuel sensor to a target air-fuel ratio switched by said target air-fuel ratio switching means after the target air-fuel ratio is switched by said target air-fuel ratio switching means.

5. A diagnosis system as claimed in claim 1, wherein said abnormality diagnosing means diagnoses the abnormality of said wide-range air-fuel ratio sensor on the basis of a time period taken to reach the detection value of said wide-range air-fuel sensor to a predetermined value after the target air-fuel ratio is switched by said target air-fuel ratio switching means.

6. A diagnosis system as claimed in claim 1, wherein said abnormality diagnosing means diagnoses the abnormality of said wide-range air-fuel ratio sensor on the basis of a time period taken to converge the detection value of said wide-range air-fuel sensor at a target air-fuel ratio switched by said target air-fuel ratio switching means after the target air-fuel ratio is switched by said target air-fuel ratio switching means.

7. A diagnosis system comprising:

a wide-range air-fuel ratio sensor detecting an air-fuel ratio of air-fuel mixture supplied to an engine; and a control unit configured to correct an air-fuel ratio controlled object on the basis of a detection result of said wide-range air-fuel ratio sensor so as to adjust the air-fuel ratio to the engine at a target air-fuel ratio, to switch the target air-fuel ratio, to detect variation of the detection value of said wide-range air-fuel ratio sensor, to diagnose said wide-range air-fuel ratio sensor on the basis of a detection result of the variation of the detection value of said wide-range air-fuel ratio sensor during a time period from the start of the switching of the target air-fuel ratio, and to set a control gain of the air-fuel ratio feedback control at a value greater than a normal control gain when the diagnosis of said air-fuel ratio sensor is executed.

* * * * *